US007832848B2

(12) United States Patent
Iijima

(10) Patent No.: US 7,832,848 B2
(45) Date of Patent: Nov. 16, 2010

(54) INK CARTRIDGE MOUNTING DEVICE AND IMAGE FORMING DEVICE

(75) Inventor: Shota Iijima, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 933 days.

(21) Appl. No.: 11/712,620

(22) Filed: Feb. 27, 2007

(65) Prior Publication Data

US 2007/0200894 A1 Aug. 30, 2007

(30) Foreign Application Priority Data

Feb. 28, 2006 (JP) ..... 2006-053099

(51) Int. Cl.
*B41J 2/17* (2006.01)

(52) U.S. Cl. ..... 347/84; 347/85; 347/49

(58) Field of Classification Search ..... 347/46, 347/7, 14, 31, 36, 49, 66, 84–87, 90
See application file for complete search history.

(56) References Cited

U.S. PATENT DOCUMENTS 5,621,450 A * 4/1997 Kawai et al. ..... 347/108
6,766,817 B2 7/2004 da Silva
6,918,404 B2 7/2005 Dias da Silva
7,066,586 B2 6/2006 da Silva
2004/0227792 A1 11/2004 Iijima et al.

FOREIGN PATENT DOCUMENTS

JP 11157098 6/1999
JP 2004-237495 8/2004

* cited by examiner

*Primary Examiner*—Juanita D Stephens
(74) *Attorney, Agent, or Firm*—Frommer Lawrence & Haug LLP

(57) ABSTRACT

An ink cartridge mounting device is presented including (1) a housing that forms a mounting space for mounting an ink cartridge, (2) a hollow ink drawing member that protrudes from an inner surface of the housing toward the mounting space, the ink drawing member being inserted into the ink cartridge to draw out an ink stored in the ink cartridge when the ink cartridge is mounted in the mounting space, and (3) an ink flow path forming portion that forms an ink flow path from the interior of the mounting space to the outside of the mounting space, along which ink from the ink drawing member flows when the ink cartridge is removed from the mounting space.

14 Claims, 4 Drawing Sheets

INK CARTRIDGE MOUNTING DEVICE AND IMAGE FORMING DEVICE

The present invention is based on Japanese Patent Application No. 2006-053099 filed Feb. 28, 2006, the contents of which are incorporated by reference.

BACKGROUND OF THE INVENTION

1. Field of the Invention

The present invention relates to an ink cartridge mounting device and an image forming device. More particularly, to an ink cartridge mounting device and an image forming device which can prevent an ink cartridge mounted therein from being smeared by ink.

2. Discussion of Related Art

Inkjet type image forming devices which eject ink from an inkjet head to form an image have been known. Such an image forming device carries an ink cartridge mounting device. The ink cartridge mounting device mounts an ink cartridge, which stores the ink to be supplied to the inkjet head.

The ink cartridge mounting device is primarily equipped with a housing which forms a mounting space for mounting an ink cartridge and a hollow ink drawing member which projects from an inner surface of the housing toward the mounting space. When the ink cartridge is mounted in the mounting space, the ink drawing member is inserted into the ink cartridge to draw out the ink stored in the ink cartridge. The ink stored in the ink cartridge is supplied to the inkjet head through the ink drawing member.

In relation to ink cartridge mounting devices of this type, JP-A-11-157098 discloses an ink cartridge mounting portion to which an ink cartridge containing an ink bag and a waste ink absorber, for absorbing unnecessary ink, can be mounted.

However, in the above-described ink cartridge mounting device (or ink cartridge mounting portion), ink adherent to the exterior of the ink drawing member can drop into the ink cartridge mounting device when the ink cartridge is removed from the ink mounting device. Such an ink droplet adheres to the ink cartridge when the ink cartridge is mounted in the ink mounting device again. As a result, the problem occurs that the ink droplet smears the ink cartridge.

The present invention has been made to solve the above-described problem, and it is an object of the invention to provide an ink cartridge mounting device and an image forming device in which an ink cartridge to be mounted is prevented from being smeared by ink.

SUMMARY OF THE INVENTION

In accordance with one embodiment of the current invention, an ink cartridge mounting device is presented including (1) a housing that forms a mounting space for mounting an ink cartridge, (2) a hollow ink drawing member that protrudes from an inner surface of the housing toward the mounting space, the ink drawing member being inserted into the ink cartridge to draw out an ink stored in the ink cartridge when the ink cartridge is mounted in the mounting space, and (3) an ink flow path forming portion that forms an ink flow path from the interior of the mounting space to the outside of the mounting space, along which ink from the ink drawing member flows when the ink cartridge is removed from the mounting space.

In accordance with another embodiment of the current invention, an ink-jet printing device is presented including (1) a housing, (2) a mounting space for mounting an ink cartridge, (3) a hollow ink drawing member, and (4) an ink flow path forming portion. Wherein the ink flow path forming portion forms an ink flow path from the interior of the mounting space to the outside of the mounting space, along which ink from the ink drawing member flows after the ink cartridge is removed from the mounting space.

In accordance with yet another embodiment of the current invention, an ink-jet printing device is presented including (1) a mounting space for mounting an ink cartridge, (2) a hollow ink drawing member, and (3) an ink flow path forming portion. Wherein the ink flow path forming portion forms an ink flow path from the interior of the mounting space to the outside of the mounting space, along which ink from the ink drawing member flows after the ink cartridge is removed from the mounting space.

DETAILED DESCRIPTION OF EMBODIMENTS

Figure 1:
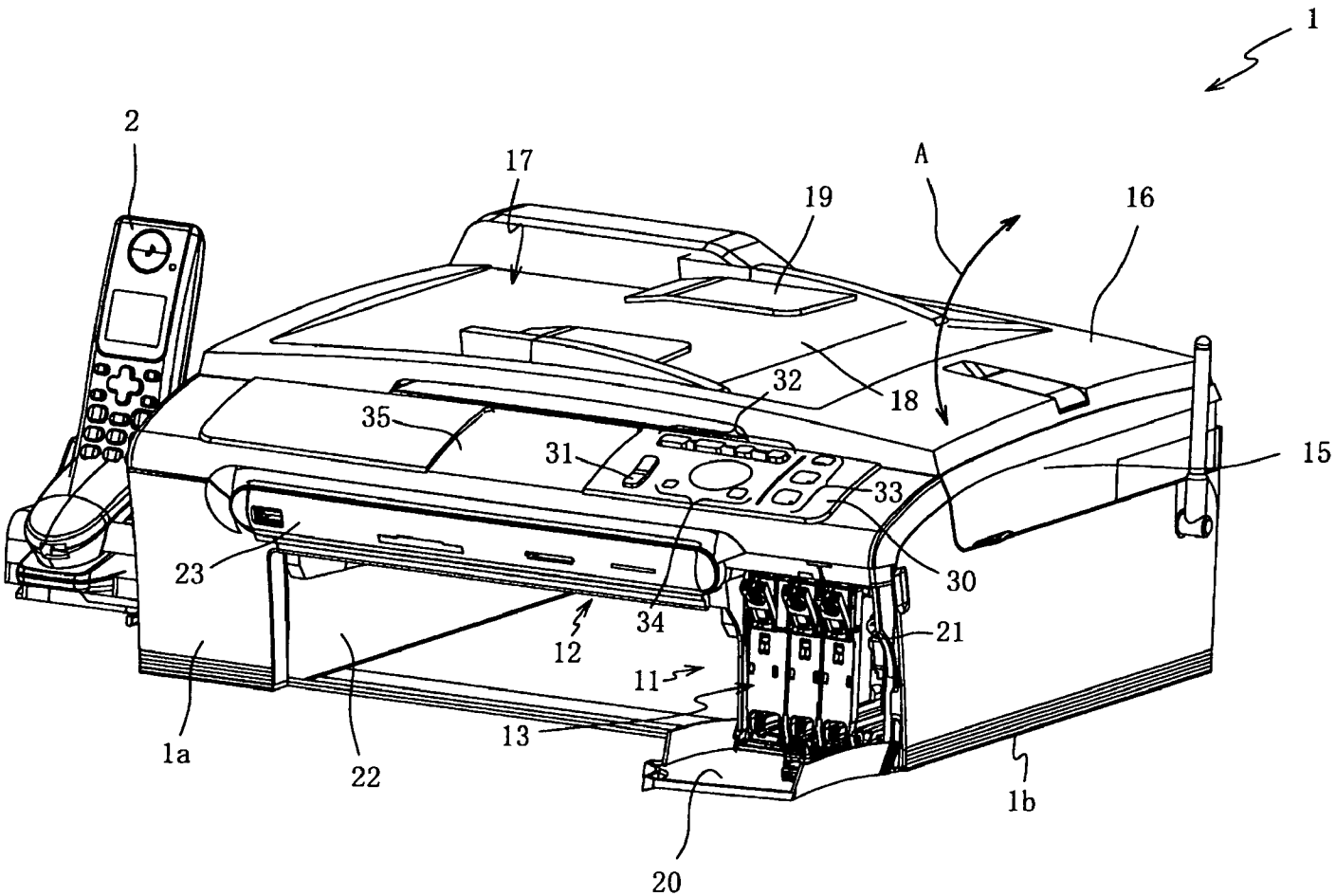
FIG. 1 is an external perspective view of a multi-function device having an ink cartridge mounting device according to one embodiment of the invention.

Referring now to the drawings, the present invention will be described in detail on the basis of the preferred embodiments.

Referring to FIG. 1, the multi-function device 1 includes a printer unit 11 provided in a lower part thereof and a scanner unit 12 provided above the printer unit 11. The multi-function device 1 is an MFD (Multi-Function Device) including the printer unit 11 and the scanner unit 12 which are integrally provided, and the device therefore has various functions such as a printer function, a scanner function, a copying function and a facsimile function.

The multi-function device 1 is primarily connected to a computer (not shown) to record images and documents on recording media, such as sheets of paper, based on image data and document data transmitted from the computer. The multi-function device 1 can also be connected to an external apparatus, such as a digital camera (not shown), to record image data output from the digital camera on recording media. The multi-function device 1 may also allow calls to be placed to another device using a handset 2, as well as allow image data to be transmitted to that other device. Further, the multi-function device 1 includes a slot unit 23 which will be described later. Various types of storage media, such as memory cards, may be mounted in the slot unit 23 so as to record data stored in the storage media on recording media, such as sheets of paper.

The scanner unit 12 includes a document placement table 15 serving as an FBS (Flatbed Scanner) and a document cover 16 provided above the document placement table 15 (shown in an upper part of FIG. 1). The document cover 16 includes an automatic document feeder (hereinafter referred to as "ADF") 17, and the cover is mounted on the rear side of the document placement table 15 (on the further side of FIG. 1) through hinges such that it can be opened and closed. Thus, the document cover 16 is opened and closed by rotating it relative to the document placement table 15 in the direction indicated by the arrow A. In the present embodiment, the document placement table 15 forms a part of the housing of the multi-function device 1, and the document cover 16 forms a part of a top surface of the multi-function device 1.

The document placement table 15 includes a contact glass plate (not shown) provided between the document cover 16 and the document placement table 15, and incorporates an image reading unit (not shown). A document is placed between the document cover 16 and the contact glass plate, and the image reading unit is moved under the contact glass plate along the contact glass plate to read an image from the document.

The document cover 16 includes the ADF 17, and the ADF 17 is configured such that it can continuously convey documents, up to a predetermined number of sheets, from a document tray 18 to a discharge tray 19. The ADF 17 will not be described in detail because it has a well-known structure. In the present embodiment, a configuration excluding the ADF 17 may be employed. In such a configuration, the document cover 16 is opened by a user to set a document on the contact glass plate.

The printer unit 11 is configured as an inkjet recording device that is an image forming device having a recording head (not shown) for ejecting ink droplets. The printer unit 11 includes an ink cartridge mounting device 13 which is located on the front side of the multi-function device 1 (on the foreground side of FIG. 1) and on the bottom side of the multi-function device 1 (on the lower side of FIG. 1). In the present embodiment, the ink cartridge mounting device 13 is configured to allow four ink cartridges 14 to be contained and held therein, and black, yellow, magenta, and cyan inks are each stored in a respective ink cartridge 14. The inks in the respective colors stored in the ink cartridges 14 are supplied to the recording head through ink tubes (not shown).

An openable lid 20 is provided on the front side of the ink cartridge mounting device 13 (on the foreground side of FIG. 1) to expose and close an opening 21 formed on an end of the front surface 1*a* (on the right-hand end of the foreground side of FIG. 1). The openable lid 20 is configured such that it can be rotated between a position reached by being tilted forward (toward the foreground side of FIG. 1) for exposing the ink cartridge mounting device 13 at the opening 21, and a position for closing the opening 21 to contain the ink cartridge mounting device 13 therein.

An opening 22 is formed in the middle of the front surface 1*a* of the multi-function device 1, and a sheet feed tray (not shown) is disposed in the opening 22 (FIG. 1 shows the device with the sheet feed tray removed). A sheet sent out from the sheet feed tray is transported toward the rear side, transported upward then, and finally conveyed toward the front side, and an image is recorded on the sheet while the sheet is being conveyed. Thereafter, the sheet is discharged onto a discharge tray (not shown) provided above the sheet feed tray inside the opening 22.

An operation panel 30 is mounted on a top surface of the front side of the multi-function device 1 (in an upper part on the foreground side of FIG. 1). The operation panel 30 is an operating portion for operating the printer unit 11 and the scanner unit 12, and various operation keys 31 to 34 and a liquid crystal display 35 are provided on the same. The various operation keys 31 to 34 disposed on the operation panel 30 are connected to a controller (not shown) for exercising major control activities through a flat cable which is not shown. The controller processes commands from the various operation keys 31 to 34, as well as from a handset 2, to control the operation of the multi-function device 1. When a personal computer or the like is connected to the multi-function device 1, the controller controls the operation of the multi-function device 1 based on instructions transmitted from the personal computer, as well as based on the instructions from the operation panel 30.

A slot 23, in which storage media such as various small memory cards can be mounted, is provided under the operation panel 30 (lower direction of FIG. 1). Image data is stored in a small memory card, and image data (or information on image data) read from the small memory card is displayed on the liquid crystal display 35. A configuration is employed to allow any image displayed on the liquid crystal display 35 to be recorded on a sheet of paper through an operation on the operation panel 30.

Figure 2:
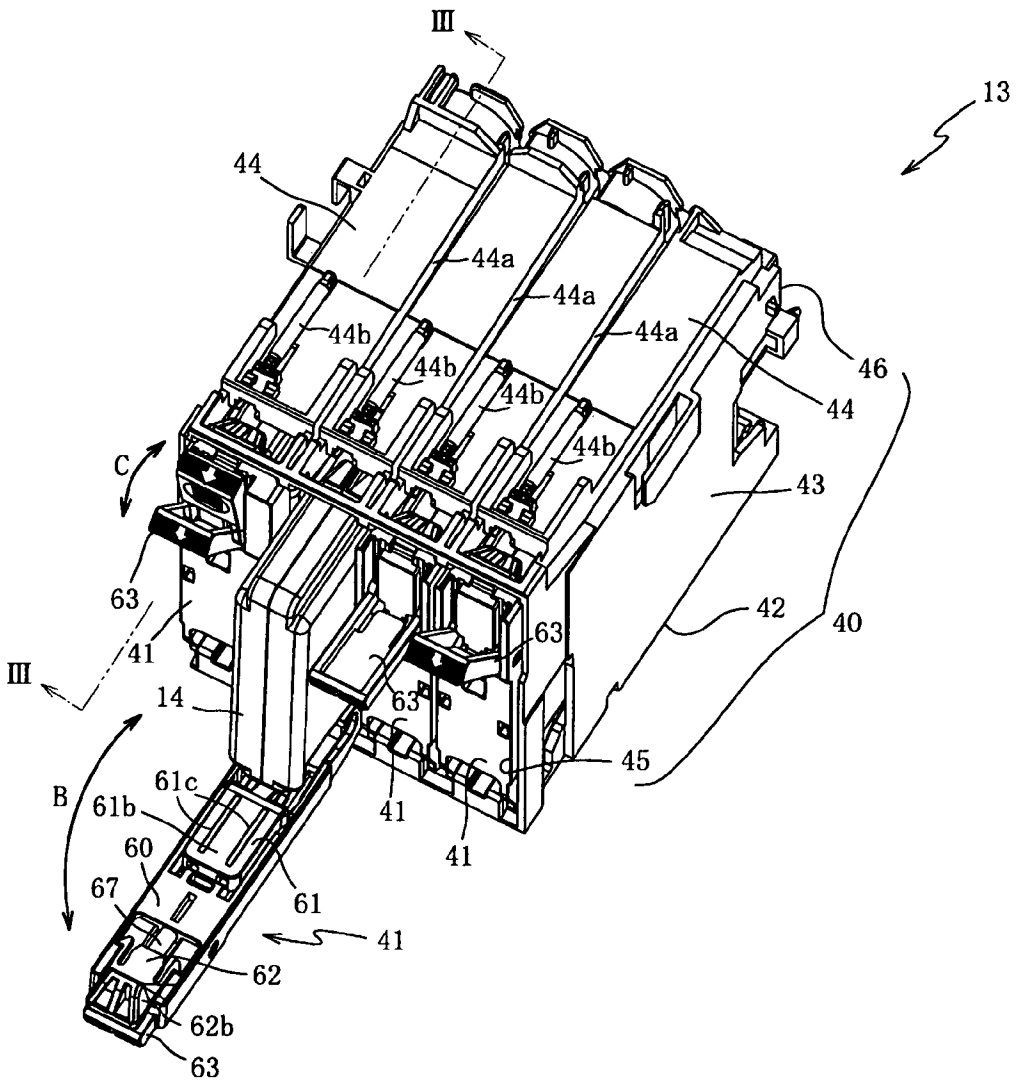
FIG. 2 is a perspective view of an ink cartridge mounting device.

A configuration of the ink cartridge mounting device 13 will now be described with reference to FIG. 2. FIG. 2 shows a state of the ink cartridge mounting device 13 in which a door 41 in the second place from the left-hand side of an array of four doors 41 of the device is open with the other three doors 41 closed.

The ink cartridge mounting device 13 primarily comprises a case 40, in which the ink cartridges 14 are removably mounted, and doors 41, which are connected to the case 40. The case 40 as a whole is substantially formed like a hollow parallelepiped rectangle, the interior of which is partitioned to form mounting spaces 50 for containing and holding the ink cartridges 14 (see FIG. 3).

In the present embodiment, the interior of the case 40 is partitioned into four mounting spaces 50, and the four ink cartridges 14 are mounted in the mounting spaces 50, respectively. The mounting spaces 50 are formed in adaptation to the external shape of the ink cartridges 14 and are configured such that the ink cartridges 14 mounted in the case 40 are held in the case 40 without shaking.

The case 40 has a bottom wall 42, a pair of sidewalls 43 erected on both of the left and right sides of the bottom wall 42, a ceiling wall 44 opposite to the bottom wall 42, openings 45 for mounting and removing the ink cartridges 14, and a rear wall 46 disposed opposite to the opening 45. The case further includes partition walls (not shown) provided therein for partitioning the interior of the case 40 to form the mounting spaces 50.

The number of the partition walls provided is determined according to the number of the ink cartridges 14 to be contained in the case 40. It is not essential that the partition walls completely separate the mounting spaces 50 from each other, and what is required is that the walls are formed at least in the form of ribs which inwardly protrude from the bottom wall 42 or ceiling wall 44 to partition adjacent mounting spaces 50.

Ribs 44*a* are erected on the ceiling wall 44 to improve the rigidity of the case 40. Further, swing arms 44*b* are provided on the ceiling wall 44. Extension springs are mounted between the swing arms 44*b* and the ceiling wall 44 to normally elastically urge the arms toward the doors 41 (leftward and toward the foreground side of FIG. 2). The swing arms 44*b* are configured such that tips thereof protruding into the case 40 are engaged with engaging portions provided on the ink cartridges 14 in the elastically urged state. Therefore, the ink cartridges 14 can be reliably held in the mounting spaces 50.

The openings 45 on the front side of the case 40 are provided in association with the respective mounting spaces 50. That is, the mounting spaces 50 are provided in the case 40 such that they are continuous with the respective openings 45, and the four ink cartridges 14 are mounted and removed in and from the mounting spaces 50 through the openings 45.

The openings 45 are opened and closed by the doors 41. A door 41 is provided at each of the openings 45, and the doors are configured to be rotated in the direction indicated by the arrow B, so as to move between a closed position for closing the openings 45 and an open position for exposing the openings 45. The doors 41 reliably hold the ink cartridges 14 in the mounting space 50 in the closed position and allow the ink cartridges 14 to be easily mounted in the mounting spaces 50 in the open position.

A door 41 includes a door body 60, a pressing member 61 provided on an inner surface of the door body 60, a door lock (lock bar) 62 for securing (locking) the door 41 to the case 40, and a lock release lever 63 for canceling the locked state of the door 41.

The door body 60 is formed like an elongate rectangular plate. The external shape of the door body 60 is formed in adaptation to the shape of the openings 45 of the case 40.

The pressing member 61 is formed like a flat plate, and a wall 61*b* of the pressing member 61 (a surface which faces a side surface of an ink cartridge 14 when the door 41 is in the closed position) is formed as a flat surface, and a pair of ribs 61*c* is formed on the wall 61*b*. Therefore, when the door 41 is in the closed position, those ribs 61*c* abut on the side surface of the ink cartridge 14 to press the ink cartridge 14.

The door lock 62 is attached to the top end of the door body 60 and is supported such that it can be slid up and down with respect to the door body 60. A coil spring 67 is interposed between the door lock 62 and the door body 60 to normally elastically urge the door lock 62 upward from the door body 60. A latch 62*b* protruding toward the case 40 is provided on the top end of the door lock 62. When the door 41 is in the closed position, the latch 62*b* engages the case 40 to lock the door 41. When the lock release lever 63 is operated, the door lock 62 is slid downward to release the lock.

The lock release lever 63 is supported such that it can be rotated in the direction indicated by the arrow C. The lever is configured to be displaceable between an upright position in which it is substantially flush with an external side surface of the door body 60, a tilted position at an inclination of about 45°, and a horizontal position in which it is substantially horizontally laid (not shown). The lock release lever 63 is connected with the door lock 62 by a cam mechanism which is not shown, and the door lock 62 is slid up and down by the cam mechanism so as to release the door lock 62 when the lock release lever 63 is moved from the upright position to the horizontal position.

Figure 3A:
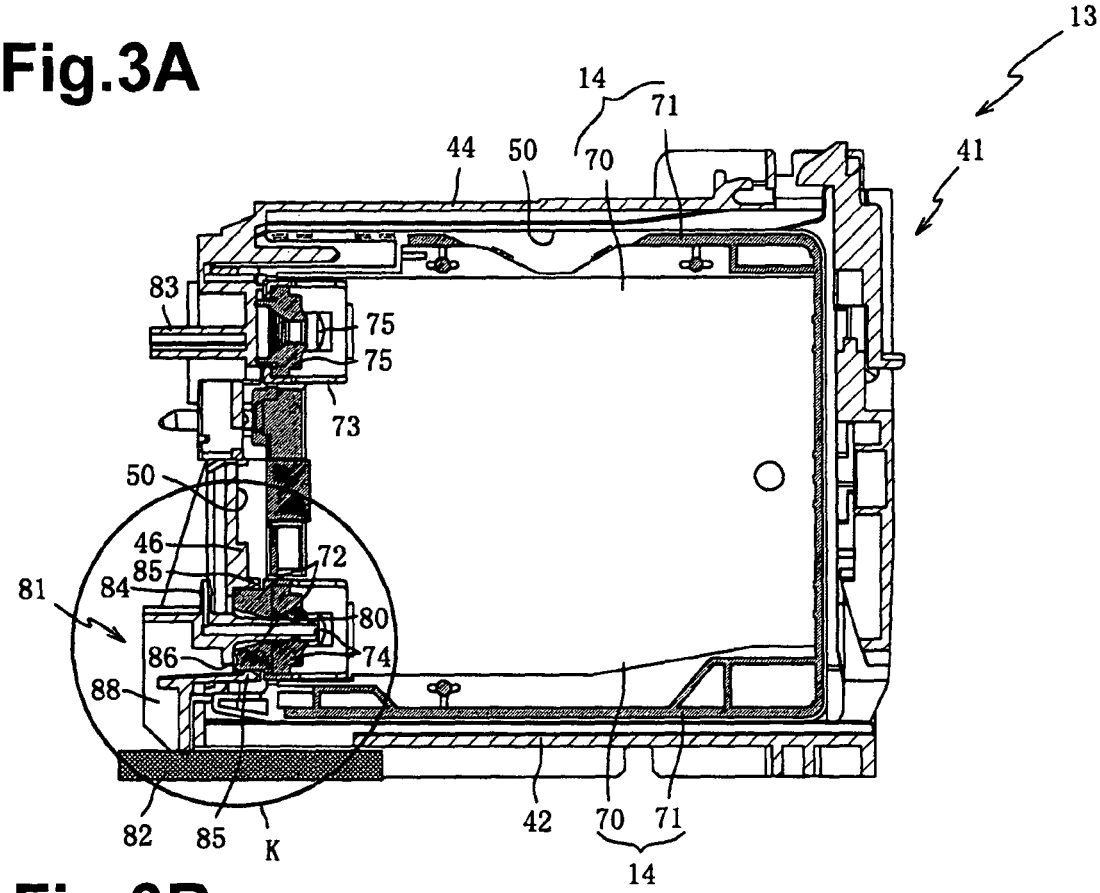
FIG. 3A is a sectional view of the ink cartridge mounting device taken along the sectional line III-III shown in FIG. 2.
Figure 3B:
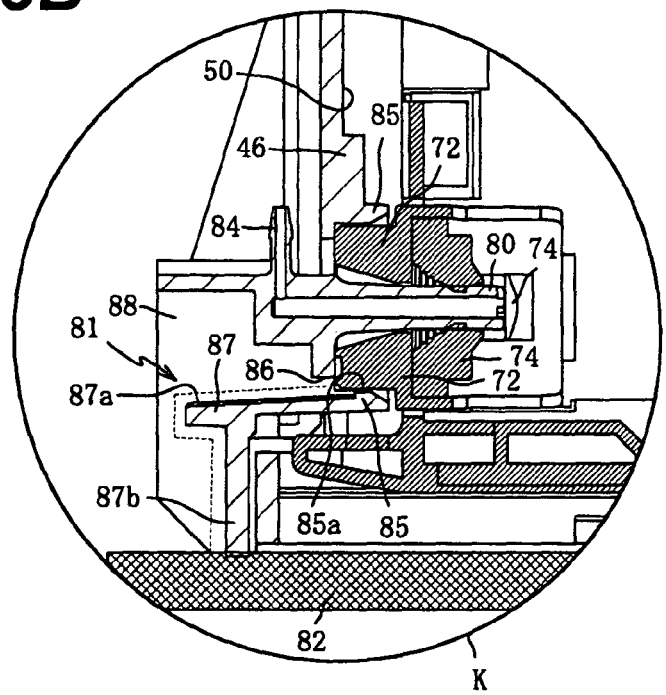
FIG. 3B is an enlarged sectional view of the region K shown in FIG. 3A.
Figure 4:
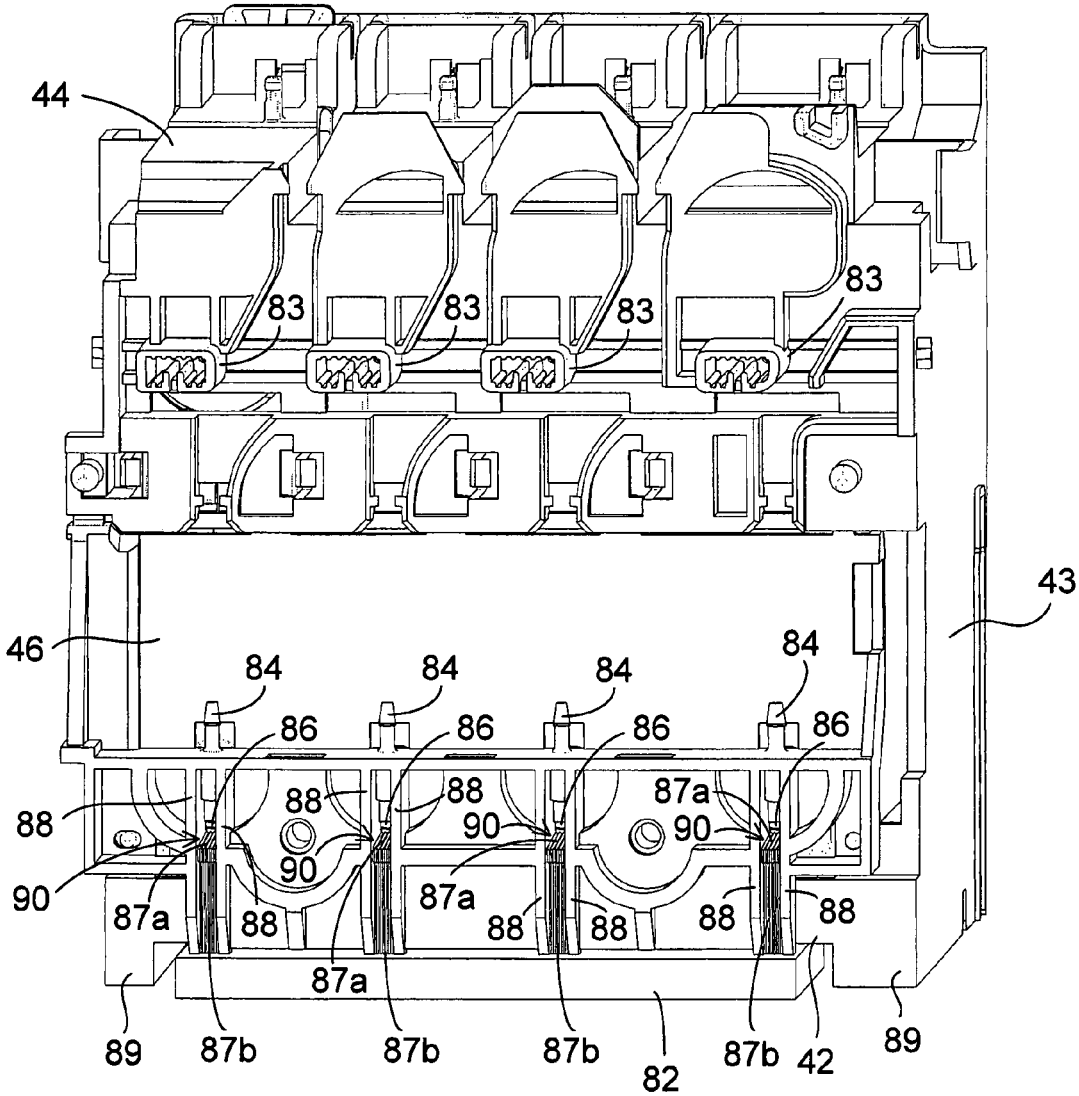
FIG. 4 is a perspective view of the ink cartridge mounting device as viewed from its rear side.

The description of the configuration of the ink cartridge mounting device 13 will be continued with reference to FIGS. 3A, 3B, and 4.

FIG. 3A shows a state of the ink cartridge mounting device 13 in which the ink cartridges 14 are mounted and the doors 41 are closed. The ink cartridges 14 are mounted in the ink cartridge mounting device 13. An ink cartridge 14 is configured to have a double structure including an inner case 70 for storing ink and an outer case 71 enclosing the inner case 70. A cylindrical ink supply port 72 is mounted on the lower side of a surface of the inner case 70 facing the rear wall 46 of the ink cartridge mounting device 13, and a cylindrical air intake port 73 is mounted on the upper side of the surface.

The cylindrical ink supply port 72 is configured in the form of a hollow cylinder protruding toward the rear wall 46. A valve mechanism 74 is incorporated in the cylindrical ink supply port 72 for allowing ink stored in the inner case 70 to flow out through an ink drawing member 80 when the ink cartridge 14 is mounted, and, conversely, for blocking the leakage of ink stored in the inner case 70 when the ink cartridge 14 is removed. Detailed illustration and description of the valve mechanism 74 is omitted.

The cylindrical air intake port 73 is configured in the form of a hollow cylinder, and a valve mechanism 75 is incorporated in the cylindrical air intake port 73 for allowing air to be introduced into the inner case 70 when the ink cartridge 14 is mounted, and, conversely, for blocking the introduction of air into the inner case 70 when the ink cartridge 14 is removed. Detailed illustration and description of the valve mechanism 75 is omitted.

In addition to the features described with reference to FIG. 2, the ink cartridge mounting device 13 in which the ink cartridges 14 are mounted includes (i) the hollow ink drawing members 80 protruding from a lower part of the rear wall 46 toward the mounting spaces 50, (ii) ink flow path forming portions 81 disposed under the ink drawing members 80, (iii) an ink absorber 82 disposed under the bottom wall 42, and (iv) hollow air intake members 83 protruding from an upper part of the rear wall 46 away from the mounting spaces 50.

When the ink cartridge 14 is mounted in the mounting space 50, an ink drawing member 80 is inserted into the cylindrical ink supply port 72 of the respective ink cartridge 14 to draw out the ink stored in the ink cartridge 14 (the inner case 70). A tube connecting portion 84 is connected with the ink drawing member 80 at the side of the drawing member 80 opposite to the tip of the drawing member 80. The tube connecting portion 84 is connected to one end of a tube (not shown) which is in turn, at its other end, connected to a recording head (not shown). The ink stored in the ink cartridge 14 is supplied to the recording head through the ink drawing member 80, the tube connecting portion 84, and the tube.

An ink flow path forming portion 81 forms a flow path for allowing ink, flowing out of the ink drawing member 80 when the ink cartridge 14 mounted in the mounting space 50 is removed from the mounting space 50, to flow from the interior of the mounting space 50 to the outside of the mounting space 50. The ink flow path forming portion 81 includes (i) a joint portion 85 in the form of a ring protruding from the rear wall 46 toward the mounting space 50 so as to surround the ink drawing member 80, (ii) a through hole 86, formed through the rear wall 46, in a position inside the joint portion 85 and under the ink drawing member 80, and (iii) an extending portion 87 extending from the through hole 86 in the direction opposite to the side where the mounting space 50 is located.

The joint portion 85 is configured in such a size that it can fit with the cylindrical ink supply port 72 so as to surround the cylindrical ink supply port 72. The ink cartridge 14 can be positioned in the mounting space 50 when the tip of the cylindrical ink supply port 72 is fitted in the joint portion 85, thereby preventing the ink cartridge 14 from rattling in the mounting space 50.

A lower inner surface of the joint portion 85 serves as a first flow path surface 85*a* which receives ink remaining on an outer circumferential surface of the ink drawing member 80 when the ink cartridge 14 is removed. The first flow path surface 85*a* allows the ink thus received to flow out of the mounting space 50 through the through hole 86.

It is therefore possible to (i) prevent the ink from dropping from the ink drawing member 80 into the mounting space 50 when the ink cartridge 14 is removed, as well as (ii) prevent the ink from adhering to the ink cartridge 14 when the ink cartridge 14 is remounted. Since the first flow path surface 85*a* is constituted by an inner surface of the joint portion 85, the joint portion 85 can be used as a substitute for a member which is otherwise to be employed to form the first flow path surface.

A top surface of the extending portion 87 constitutes a second flow path surface 87*a* which serves as a flow path for the ink flowing out through the through hole 86. The ink flowing out through the first flow path surface 85*a* and though the through hole 86 flows on the second flow path surface 87*a* to exit in the opposite direction to the mounting space 50. The extending portion 87 is supported on a support wall 87*b*. The support wall 87*b* is connected to a surface opposite to the surface constituting the second flow path surface 87*a*, and extends toward the ink absorber 82.

The above-described first flow path surface 85*a*, the lower inner surface forming a part of the through hole 86, and the second flow path surface 87*a* are each formed to have a continuous linear surface inclined downward from the upstream side (the side of the first flow path surface 85*a*) toward the downstream side (the side of the second flow path surface 87*a*) in the sectional view. As a result, the ink can smoothly flow out from the first flow path surface 85*a* toward the second flow path surface 87*a*. As shown in FIG. 4, a plurality of grooves 90 having a V-shaped section extending in the direction if ink flow are formed on (i) the first flow path surface 85*a*, (ii) the lower inner surface forming a part of the through hole 86, and (iii) the second flow path surface 87*a*. Thus, the capillarity of the grooves allows the ink to flow out more smoothly. The plurality of grooves are continuously formed on one end of the second flow path surface 87*a*, a surface of the extending portion 87 opposite to the second flow path surface 87*a*, and the support wall 87*b*.

Further, a pair of guide walls 88 extending in the vertical direction of the rear wall 46 are each connected to an edge of the second flow path surface 87*a* as shown in FIG. 4. It is therefore possible to direct the ink flowing on the second flow path surface 87*a* as desired. Since the pair of guide walls 88 are connected to the rear wall 46, it is possible to improve the rigidity of the rear wall 46, as well as the rigidity of the case 40.

The ink absorber 82 absorbs ink flowing from the ink flow path forming portions 81, and it is constituted by a plate-like porous member. Legs 89 are connected to the sidewalls 43, and the legs 89 form a space between the bottom wall 42 and the surface on which the ink cartridge mounting device 13 is placed. The ink absorber 82 is disposed in that space so as to extend a greater distance in the direction toward the mounting space 50 than in the direction away from the mounting space 50 (toward the second flow path surface 87*a*). Therefore, a space for disposing the ink absorber 82 can be saved. The ink flowing out through the ink flow path forming portions 81 is absorbed by the ink absorber 82.

In the above-described ink cartridge mounting device 13, when the door 41 is opened and the ink cartridge 14 is inserted into the mounting space 50 via the opening 45, the ink drawing member 80 is inserted into the cylindrical ink supply port 72. The valve mechanism 74 is then disengaged by the ink drawing member 80 to establish communication between the interior of the ink cartridge 14 and the ink drawing member 80. As a result, the tip of the ink drawing member 80 is submerged in the ink when the ink cartridge 14 is mounted.

When the ink cartridge 14 is inserted, a part (not shown) of the valve mechanism 75 incorporated in the cylindrical air intake port 73 abuts on an inner surface of the rear wall 46 to disengage the valve mechanism 75. Thus, communication is established between the interior of the ink cartridge 14 and the air intake member 83. This allows air to be introduced into the ink cartridge 14 through the air intake member 83 and the cylindrical air intake port 73.

When the ink cartridge 13 is removed from the mounting space 50, the ink adheres to the outer circumferential surface of the ink drawing member 80. The adherent ink drops from the outer circumferential surface of the ink drawing member 80 and is received by the first flow path surface 85*a*. Next, the ink flows through the first flow path surface 85*a*, and the through hole 86, onto the second flow path surface 87*a*, and drops from one end of the second flow path surface 87*a* along the surface of the extending portion 87 opposite to the second flow path surface 87*a* and the support wall 87*b* onto the ink absorber 82, where the ink is then absorbed.

Thus, when the ink cartridge 14 is removed from the mounting space 50, the ink adherent to the outer circumferential surface of the ink drawing member 80 flows out from the interior of the mounting space 50 to the outside of the mounting space 50. Therefore, the ink will not drop into the mounting space 50, and the ink cartridges 14 to be remounted can be prevented from being smeared by ink.

While the invention has been described above based on a preferred embodiment of the invention, it will be easily understood that the invention is not limited to the above-described embodiment.

For example, in the above-described embodiment, the first flow path surface 85*a*, the lower inner surface forming a part of the through hole 86, and the second flow path surface 87*a* have been described as being inclined downward and linearly extending from the upstream side toward the downstream side in a sectional view. However, an alternative configuration may be employed, in which steps are formed at the junction between the first flow path surface 85*a* and the lower inner surface forming a part of the through hole 86 and at the junction between the lower inner surface forming a part of the through hole 86 and the second flow path surface 87*a*, while the first flow path surface 85*a*, the lower inner surface forming a part of the through hole 86, and the second flow path surface 87*a* are kept inclined downward from the upstream side to the downstream side. Ink can be made to smoothly flow out also in such a case.

In an ink cartridge mounting device according to one embodiment of the current invention, ink located on the exterior of the ink drawing member, when the ink cartridge is removed from the mounting space, is made to flow from the interior of the mounting space to the exterior of the mounting space via the ink flow path forming portion. Thus, the ink will not drop into the interior of the device. This is advantageous in that the ink cartridge to be remounted can be prevented from being smeared by the ink.

In an ink cartridge mounting device according to another embodiment of the current invention, another advantage is provided in that the ink flowing on the exterior of the ink drawing member is made to flow from the interior of the mounting space to the outside of the mounting space through a first flow path surface and a through hole. Thus, the ink will not drop into the interior of the device. This is advantageous in that the ink cartridge to be remounted can be prevented from being smeared by the ink.

In an ink cartridge mounting device according to yet another embodiment of the current invention, a further advantage is provided in that the ink will not be stopped or delayed at the junction between the first flow path surface and a part of an inner circumferential surface of the through hole. This is advantageous in that the ink can be made to smoothly flow out from the interior of the mounting space to the outside of the mounting space.

In another embodiment of the present invention, an additional advantage is provided by the ink cartridge mounting device in that the first flow path surface can be formed by an inner circumferential surface of a joint portion for fixing the ink cartridge in the mounting space. This is advantageous in that a reduction in manufacturing cost and simplification of the structure can be achieved by using a single member for multiple functions.

In yet another embodiment of the present invention, a further advantage is provided by the ink cartridge mounting device in that the ink which has passed through the through hole, flows along a second flow path surface away from the mounting space. This is advantageous in that the ink can be prevented from adhering to the side wall after passing through the through hole.

In an ink cartridge mounting device according another embodiment of the present invention, an additional advantage is provided in that the ink will not be stopped or delayed at a junction between the second flow path surface and the part of the inner circumferential surface of the through hole. This is advantageous in that the ink can be made to smoothly flow from the interior of the mounting space to the outside of the mounting space.

In an ink cartridge mounting device according to yet another embodiment of the present invention, a further advantage is provided in that a pair of guide walls, each connected to an edge of the second flow path surface, regulate the ink flow from the mounting space and prevent the ink from dropping from the edges of the second flow path surface.

In another embodiment of the present invention, an additional advantage is provided by the ink cartridge mounting device in that the pair of guide walls are connected to the side wall, and therefore can provide a function of reinforcing the side wall as well as the ink cartridge mounting device. This is advantageous in that the manufacturing cost of the device can be reduced by using a single member for multiple functions.

In yet another embodiment of the present invention, a further advantage is provided by the ink cartridge mounting device in that a groove having a V-shaped section extending in the direction of the ink flow is formed in at least part of the ink flow path forming portion. This is advantageous in that the ink can be made to smoothly flow out by the capillarity of the V-shaped groove.

In an ink cartridge mounting device according another embodiment of the present invention, an additional advantage is provided in that the ink flow path is angled downward in the direction of ink flow. In this way, the ink can be made to smoothly flow out along the ink flow path.

In an ink cartridge mounting device according yet another embodiment of the present invention, a further advantage is provided in that an absorber disposed outside the mounting space can prevent an interior of an image forming device, in which the ink cartridge mounting device is located, from being smeared by the ink that has flowed from the ink path forming portion.

In another embodiment of the present invention, an additional advantage is provided by the ink cartridge mounting device in that the absorber disposed under the bottom wall extends toward the mounting space, thereby requiring less space. Thus the size of an image forming device having the ink cartridge mounting device can be reduced.

In yet another embodiment of the present invention, an image forming device includes the ink cartridge mounting device. The image forming device can therefore provide the same advantage as that of the ink cartridge mounting device.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. An ink cartridge mounting device comprising:

a housing that forms a mounting space for mounting an ink cartridge;

a hollow ink drawing member that protrudes from an inner surface of the housing toward the mounting space, the ink drawing member being inserted into the ink cartridge to draw out an ink stored in the ink cartridge when the ink cartridge is mounted in the mounting space; and an ink flow path forming portion that forms an ink flow path from the interior of the mounting space to the outside of the mounting space, along which ink from the ink drawing member flows when the ink cartridge is removed from the mounting space;

wherein the housing comprises:

a bottom wall; and a side wall erected from the bottom wall to form the inner surface of the housing from which the ink drawing member protrudes;

wherein the ink flow path forming portion comprises:

a first flow path surface extending from a part of the side wall located between the ink drawing member and the bottom wall toward the mounting space; and a through hole formed through a part of the side wall located between the first flow path surface and the ink drawing member;

wherein a joint portion protrudes from the side wall toward the mounting space so as to surround the ink drawing member, and is configured to fit with the ink cartridge; and wherein the first flow path surface is formed by an inner circumferential surface of the joint portion.

2. The ink cartridge mounting device according to claim 1;

wherein the first flow path surface is formed continuously with a part of an inner circumferential surface of the through hole such that both the first flow path surface and the part of the inner circumferential surface have a linear surface in a sectional view.

3. The ink cartridge mounting device according claim 1;

wherein the ink flow path forming portion includes a second flow path surface extending from the part of the side wall where the through hole is located, or extending from a part of the side wall located closer to the bottom wall than the through hole, in a direction opposite to the mounting space.

4. The ink cartridge mounting device according to claim 3;

wherein the second flow path surface is formed continuously with a part of an inner circumferential surface of the through hole such that both the second flow path surface and the part of the inner circumferential surface have a linear surface in a sectional view.

5. The ink cartridge mounting device according to claim 3;

wherein the second flow path surface comprises a first edge and a second edge;

wherein the first edge of the second flow path is connected to a first guide wall, the first guide wall extending in a vertical direction of the side wall; and wherein the second edge of the second flow path is connected to a second guide wall, the second guide wall extending in the vertical direction of the side wall.

6. The ink cartridge mounting device according to claim 5;

wherein the first guide wall is connected to the side wall; and wherein the second guide wall is connected to the side wall.

7. The ink cartridge mounting device according to claim 1;

wherein at least a part of the ink flow path forming portion is angled downward in the direction of ink flow.

8. The ink cartridge mounting device according to claim 1;

further comprising an absorber disposed outside the mounting space at a downstream side of the ink flow path forming portion;

wherein the absorber absorbs the ink flowing out from the ink flow path forming portion.

9. The ink cartridge mounting device according to claim 8, further comprising:

a leg for raising the bottom wall;

wherein the absorber is disposed in a space formed under the bottom wall and extends a greater distance toward the mounting space than away from the mounting space.

10. An image forming apparatus for forming an image on a recording medium using ink supplied from an ink cartridge, the image forming apparatus comprising:

an in cartridge mounting device according to claim 1.

11. An ink cartridge mounting device comprising:

a housing that forms a mounting space for mounting an ink cartridge;

a hollow ink drawing member that protrudes from an inner surface of the housing toward the mounting space, the ink drawing member being inserted into the ink cartridge to draw out an ink stored in the ink cartridge when the ink cartridge is mounted in the mounting space; and an ink flow path forming portion that forms an ink flow path from the interior of the mounting space to the outside of the mounting space, along which ink from the ink drawing member flows when the ink cartridge is removed from the mounting space;

wherein a groove having a V-shaped section is formed along at least a part of the ink flow path forming portion so as to extend in the direction of ink flow.

12. An ink cartridge mounting device comprising:

a housing;

a mounting space for mounting an ink cartridge;

a hollow ink drawing member; and an ink flow path forming portion;

wherein the ink flow path forming portion forms an ink flow path from the interior of the mounting space to the outside of the mounting space, along which ink from the ink drawing member flows after the ink cartridge is removed from the mounting space;

wherein the housing comprises:

a bottom wall; and a side wall;

wherein the side wall is connected to the bottom wall to form an inner surface of the housing;

wherein the ink flow path forming portion comprises:

a first flow path surface located inside the mounting space; and a through hole formed through a part of the side wall;

wherein the ink flow path forming portion includes a second flow path surface located outside the mounting space;

wherein the first flow path surface is formed continuously with a part of an inner circumferential surface of the through hole;

wherein the second flow path surface is formed continuously with the part of the inner circumferential surface of the through hole; and wherein the first flow path surface, the part of the inner circumferential surface, and the second flow path surface all have a linear surface in a sectional view.

13. The ink cartridge mounting device according to claim 12;

wherein the first flow path surface is formed continuously with a part of an inner circumferential surface of the through hole such that both the first flow path surface and the part of the inner circumferential surface have a linear surface in a sectional view.

14. The ink cartridge mounting device according to claim 12;

further comprising an absorber disposed outside the mounting space at a downstream side of the ink flow path forming portion;

wherein the absorber absorbs the ink flowing out from the ink flow path forming portion; and wherein the absorber is disposed in a space formed under the bottom wall and extends a greater distance toward the mounting space than away from the mounting space.

* * * * *